US007214097B1

(12) United States Patent
Hsu et al.

(10) Patent No.: US 7,214,097 B1
(45) Date of Patent: May 8, 2007

(54) ELECTRICAL CONNECTOR WITH GROUNDING EFFECT

(75) Inventors: I-Chang Hsu, Taipei Hsien (TW); Fu-Chen Chou, Taipei Hsien (TW); Wen-Ta Chiu, Taipei Hsien (TW); Chia-Yen Chai, Taipei Hsien (TW)

(73) Assignee: Comax Technology Inc., Taipei Hsien (TW)

( * ) Notice: Subject to any disclaimer, the term of this patent is extended or adjusted under 35 U.S.C. 154(b) by 0 days.

(21) Appl. No.: 10/815,861

(22) Filed: Apr. 2, 2004

(30) Foreign Application Priority Data

Mar. 16, 2004 (TW) ..... 93203973 U

(51) Int. Cl.
*H01R 9/03* (2006.01)

(52) U.S. Cl. ..... 439/610

(58) Field of Classification Search ..... 439/610, 439/607–609, 108; 174/88 C
See application file for complete search history.

(56) References Cited

U.S. PATENT DOCUMENTS 4,501,459 A * 2/1985 Chandler et al. ..... 439/295
5,456,618 A * 10/1995 Nakamura ..... 439/610
5,823,825 A * 10/1998 Murphy ..... 439/610
6,299,487 B1 * 10/2001 Lopata et al. ..... 439/610
6,722,898 B2 * 4/2004 Peloza et al. ..... 439/108

* cited by examiner

*Primary Examiner*—Alexander Gilman
(74) *Attorney, Agent, or Firm*—Troxell Law Office, PLLC

(57) ABSTRACT

The present invention relates to an electrical connector with grounding effect, which mainly has grounding part inserted inside the insulating body contacted with the jacket layer enclosed over the signal transmitting units with fixing and contacting effect for generating electrical characteristics, such that the cable assembly of the electrical connector has grounding effect without any grounding line positioned inside cable assembly; wherein, the grounding part has contacting part for providing the jacket layer to contact with, besides it further comprise predetermined grounding terminals extended directly from the grounding part for inserting into the insulating body; such that the cable assembly of the electrical connector of the present invention has grounding effect without any grounding line positioned inside the cable assembly; furthermore, it also can lessen the soldering process and prevent the mistaken probability of the soldering process generated such that the entire assembly process and the relative cost can be reduced.

6 Claims, 7 Drawing Sheets

ELECTRICAL CONNECTOR WITH GROUNDING EFFECT

BACKGROUND OF THE INVENTION

1. Field of the Invention

The present invention relates to an electrical connector with grounding structure suitable for high frequency transmitting, which mainly has the grounding part inserted inside the insulating body contacted with the jacket layer enclosed over the signal transmitting units with fixing and contacting effect for generating electrical characteristics, such that the cable assembly of the electrical connector has grounding effect without any grounding line positioned inside the cable assembly; furthermore, it also can shrink the soldering process such that the entire assembly process and the relative cost can be lessened.

2. Description of the Related Art

Generally, the most grounding structure of the prior art connector used on the motherboard of the computer mainly is soldered directly to the grounding line to the grounding terminals, however, due to the science and technology is increasing continuously and the environmental protection issue raising, the assembly process of the electronic industry is leading to lead-ness process progressively.

One of the grounding structures of the prior art connector has been found in the U.S. Pat. No. 6,489,563 B1 patent, wherein, the patent uses a grounding sleeve as a contact between the grounding line and grounding terminals; however, the grounding sleeve still needs to be soldered to the grounding terminals so as to form electrical contact.

However, the grounding design of the connector according to the U.S. Pat. No. 6,489,563 B1 patent may improve the electrical characteristics, but it has no contribution to the environmental protection considering and assembly process; besides easily generates environmental pollution during the soldering process, it also easily causes departing effect if the soldering process is not complete or not certain, further, decreases the grounding effect and electrical characteristics; meanwhile, the assembly structure of the prior art not only increases the cost and wastes man power, but has a poor yield rate, such that the manufacturing cost will be increased for no reason and not conform to cost effectiveness.

SUMMARY OF THE INVENTION

According to one aspect of the present invention, the present invention provides a high frequency connector with easy grounding part, which overcomes some, or all of the previously delineated drawbacks of the prior art connector, furthermore, it substantially can reduce the material cost and reduce the soldering process such that makes the connector to have the best electrical characteristics.

For reaching the aforesaid object, wherein, the connecting part comprises grounding part inserted inside the insulating body contacted with the jacket layer enclosed over the signal transmitting units with fixing and contacting effect for generating electrical characteristics, such that the cable assembly of the electrical connector has grounding effect without any grounding line positioned inside the cable assembly.

DETAILED DESCRIPTION OF THE PREFERRED EMBODIMENT

Figure 1:
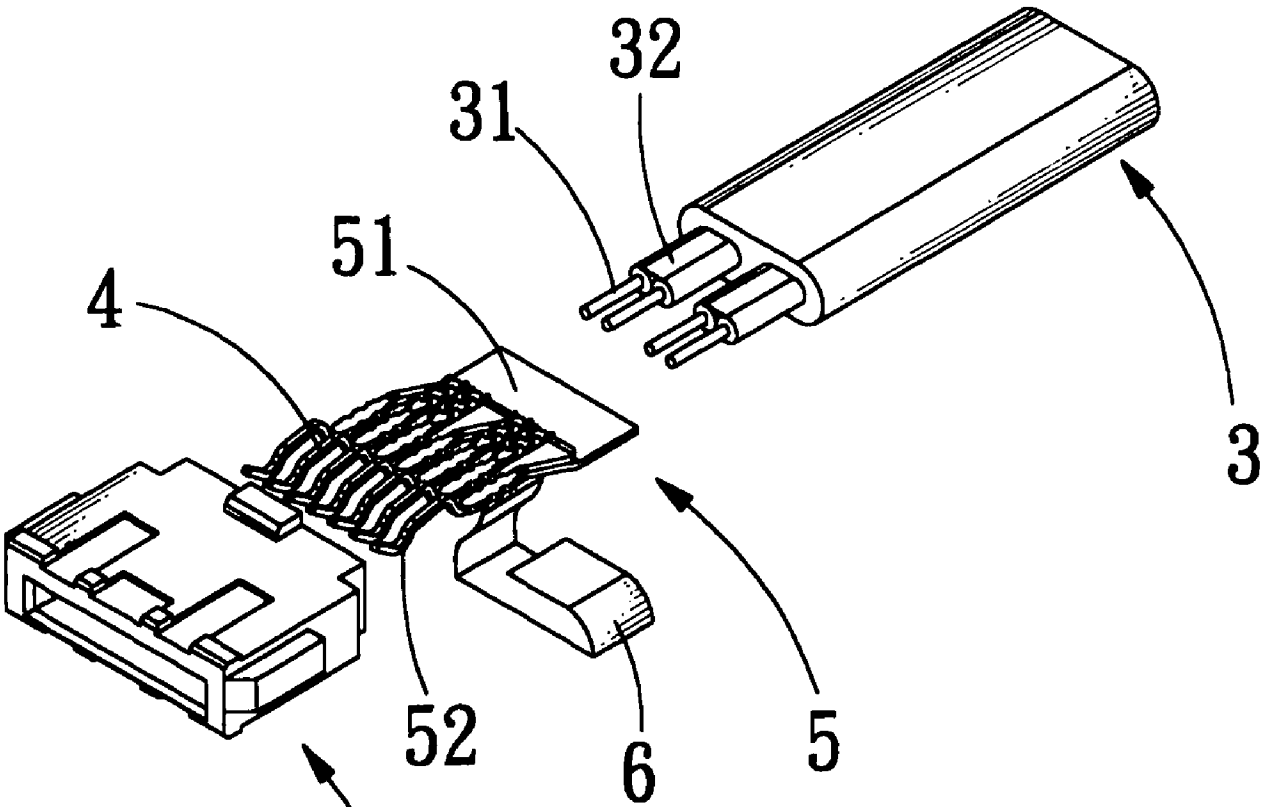
FIG. 1 shows an exploded view of the electrical connector with grounding structure according to one embodiment of the present invention.
Figure 2:
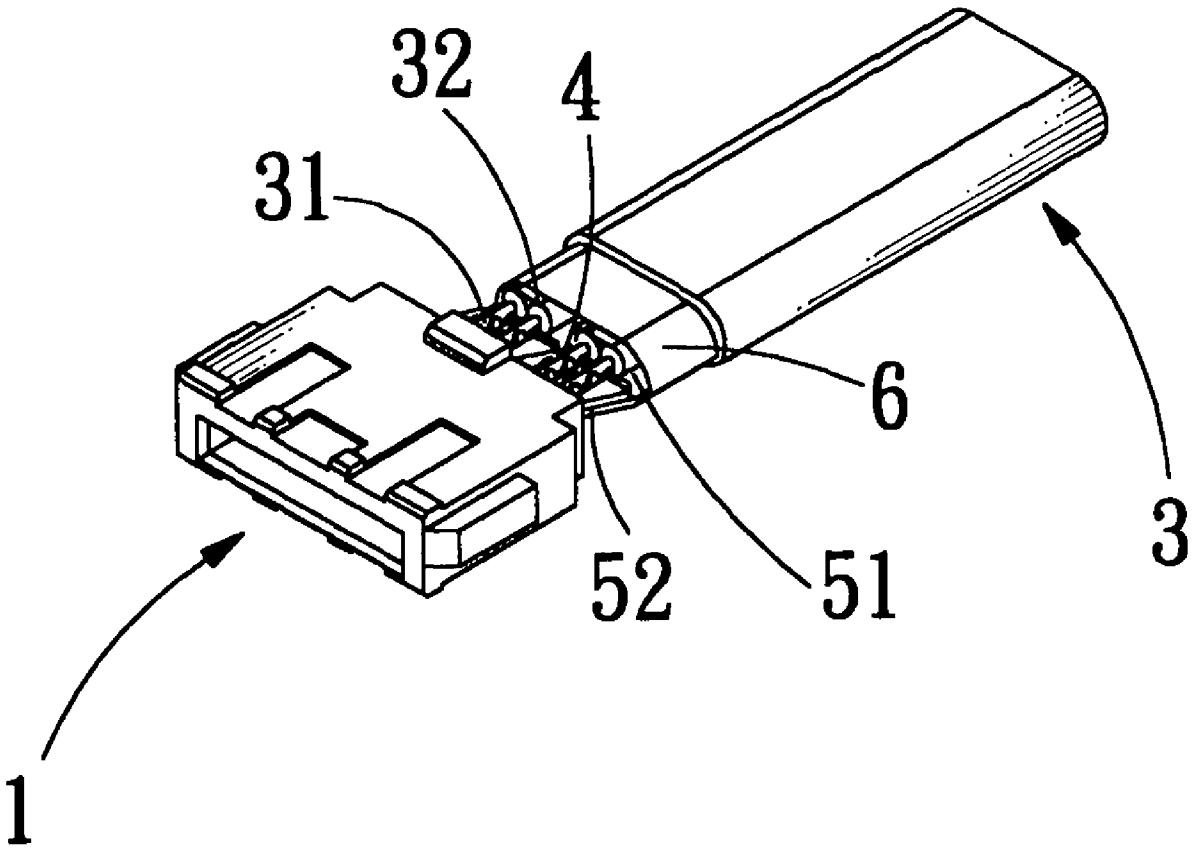
FIG. 2 shows an assembly view of the electrical connector with grounding structure according to one embodiment of the present invention.
Figure 3:
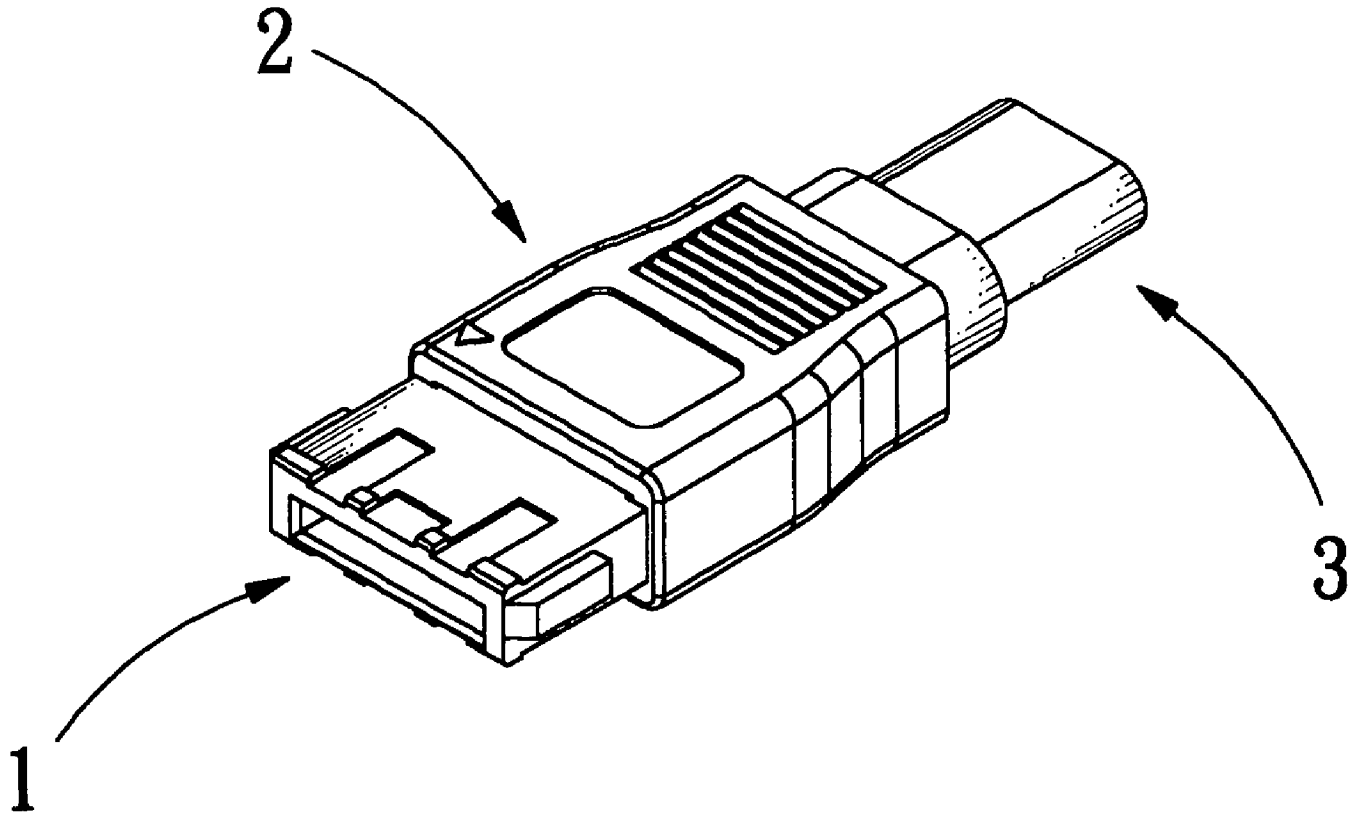
FIG. 3 shows a completely perspective view of the electrical connector with grounding structure according to one embodiment of the present invention.

Referring to FIGS. 1~3, which respectively show the exploded view and assembly view of the electrical connector with grounding structure according to one embodiment of the present invention. As shown in the FIGS., the electrical connector with grounding structure of the present invention mainly comprises: an insulating body 1, for providing a plurality of transmitting terminals 4 inserted therein; a cable assembly 3, comprising predetermined transmitting units 31 positioned over the transmitting terminals 4 and a jacket layer 32 with fixing and conducting effect enclosed outside the transmitting units 31, wherein the jacket layer 32 is an aluminum foil Mylar, preferably; a grounding part 5, comprising a contacting part 51 for contacting with the jacket layer 32, and comprising predetermined grounding terminals 52 extended directly from the contacting part 51 for inserting into the insulating body 1; a conducting part 6 is enclosed over the jacket layer 32 and the grounding part 5 to improve the contact effect, wherein, the conducting part 6 is made of metal material with electrical characteristics such as copper sheet or copper ring; and an outer jacket 2, for enclosing all aforesaid elements inside.

According to the aforesaid structure, the electrical connector with grounding structure of the present invention mainly makes the grounding part 5 be inserted inside the insulating body 1 and contacted with the jacket layer 32 with fixing and conducting effect enclosed outside the transmitting units 31, and a conducting part 6 is fully enclosed over the jacket layer 32 and the grounding part 5, such that the grounding part 5, the jacket layer 32 and the conducting part 6 can be fully conducted and generated electrical characteristics; thereby, the cable assembly 3 of the electrical connector has grounding effect without any grounding line positioned inside cable assembly 3.

Figure 4:
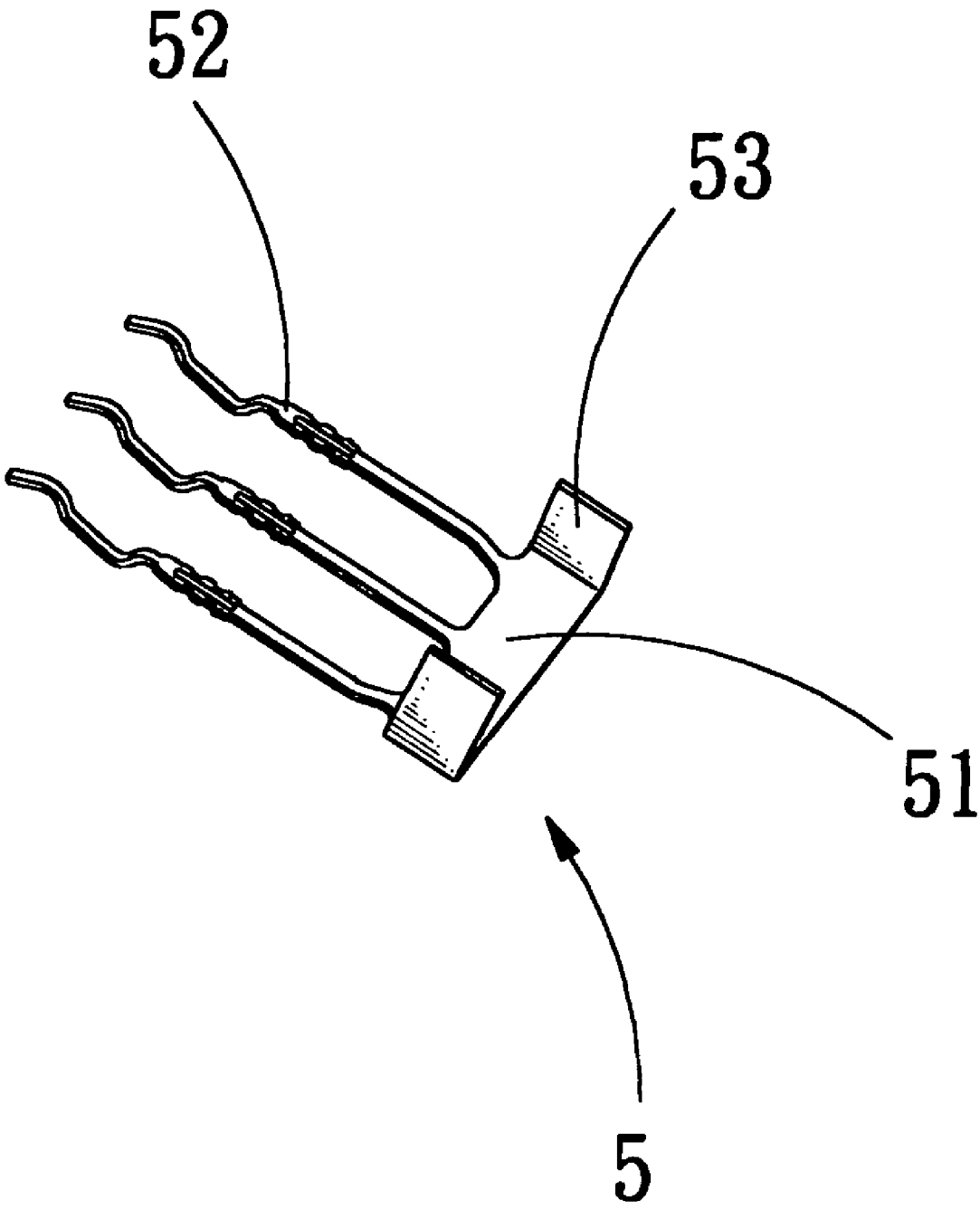
FIG. 4 shows an assembly view of the electrical connector with grounding structure according to another embodiment of the present invention.

Wherein, the grounding part 5 comprises the contacting part 51 for contacting with the jacket layer 32, besides it further comprises the predetermined grounding terminals 52 extended directly from the grounding part 5 for inserting into the insulating body 1; furthermore, both sides of the contacting portion 51 further respectively comprise a wing portion 53 to provide pressing and fitting (please refer to FIG. 4), so as to cause the grounding part 5 and the jacket layer 32 having better conducting effect.

Figure 5:
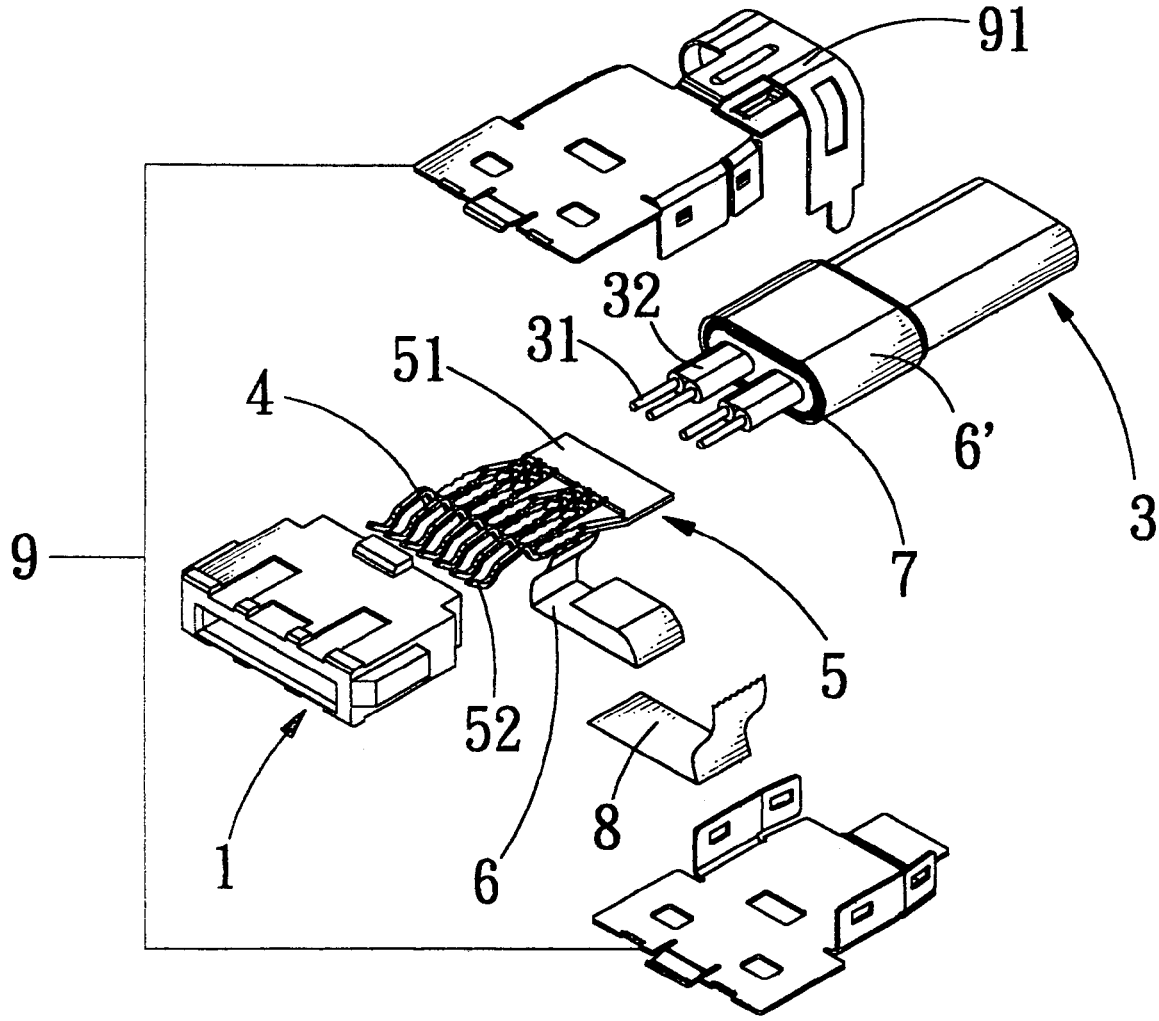
FIG. 5 shows an exploded view of the electrical connector with grounding structure according to another embodiment of the present invention.
Figure 6:
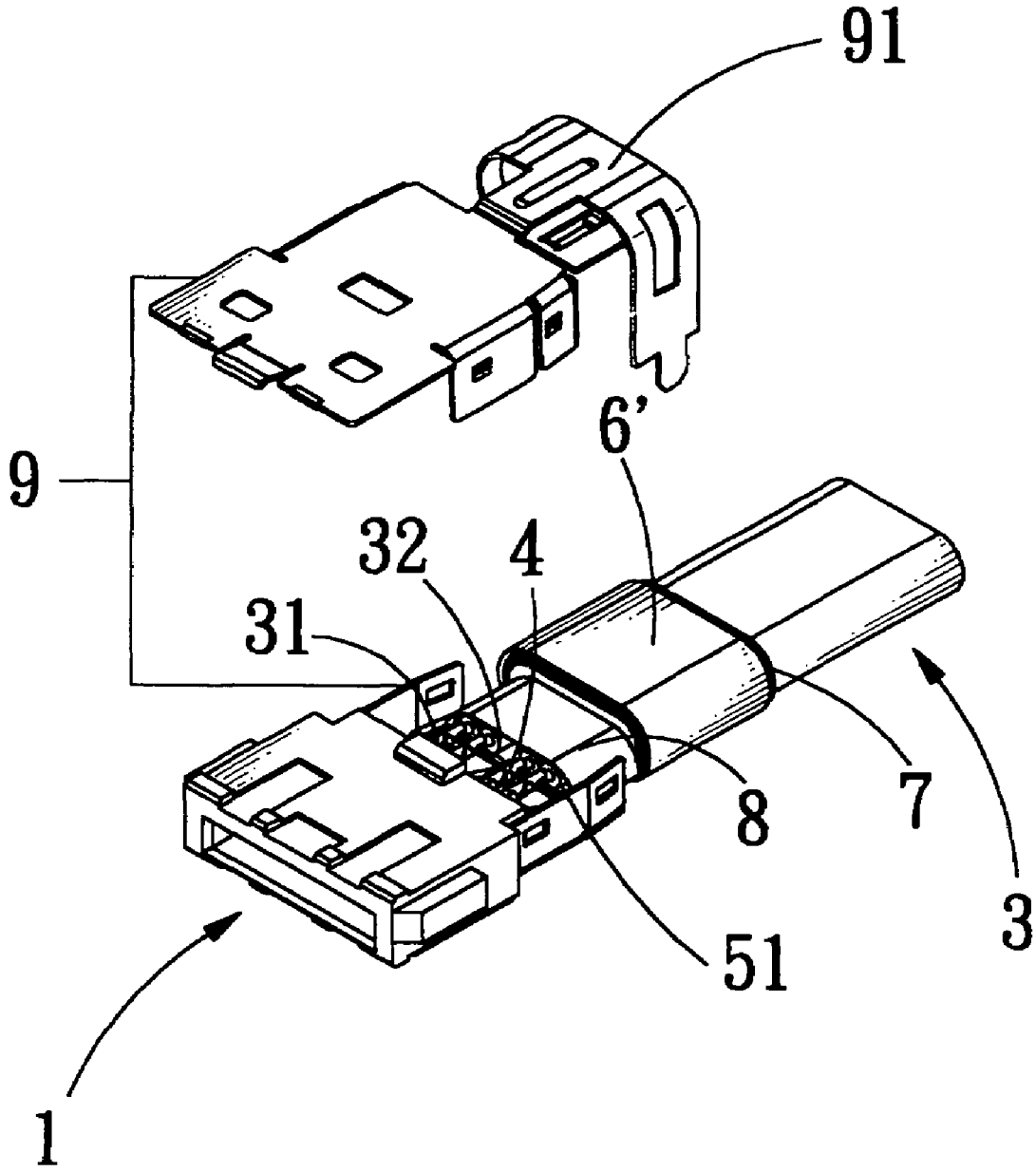
FIG. 6 shows an exploded view of the electrical connector with grounding structure according to still another embodiment of the present invention.
Figure 7:
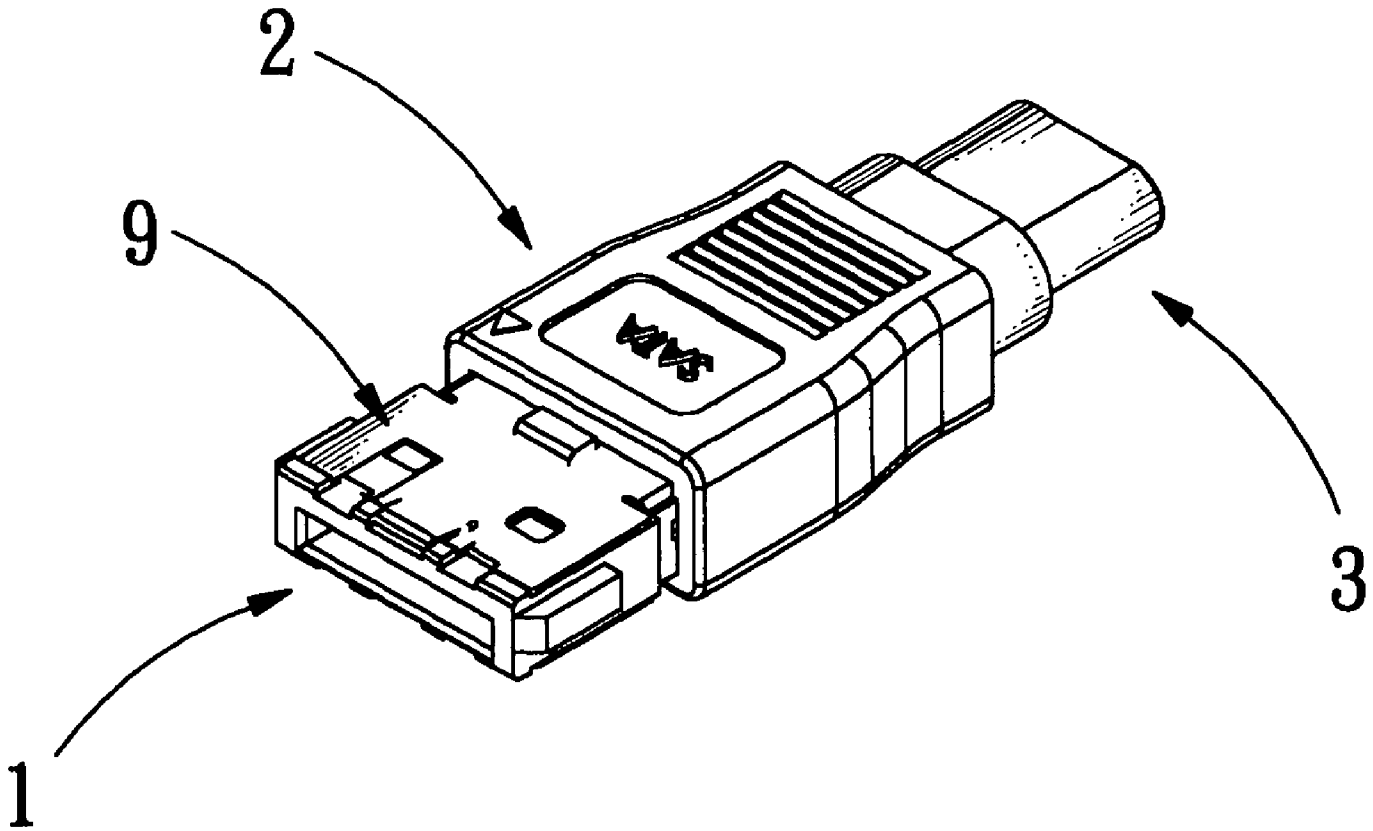
FIG. 7 shows an assembly view of the electrical connector with grounding structure according to still another embodiment of the present invention.

As shown in FIGS. 5~7, which respectively show the exploded view and assembly view of the electrical connector with grounding structure according to another embodiment of the present invention. As shown in the Figs., the electrical connector with grounding structure of the present invention is designed for cable assembly 3 with metal braid 7, which comprises: an insulating body 1, for providing a plurality of transmitting terminals 4 inserted therein; a cable assembly 3, comprising predetermined transmitting units 31 positioned over the transmitting terminals 4 and a jacket layer 32 with fixing and conducting effect enclosed outside the transmitting units 31, wherein the jacket layer 32 is an aluminum foil Mylar, preferably; and the jacket layer 32 is enclosed by metal braid 7 with electrical characteristics that is bent from the opening end of the cable assembly 3 from inwardly to outwardly and extended outside the cable assembly 3; a grounding part 5, comprising a contacting part 51 for contacting with the jacket layer 32, and comprising predetermined grounding terminals 52 extended directly from the grounding part 5 for inserting into the insulating body 1; and two conducting parts 6, 6', wherein, one conducting part 6 is used to enclose the jacket layer 32 and the conducting part 51 more tightly, and the conducting parts 6 is enclosed by an insulating layer 8, for example but not limited to an insulating gummed tape, and a insulating layer 8 is enclosed over the conducting part 6; while another conducting part 6' is used to enclose over the metal braid 7; wherein, the two conducting parts 6, 6' are made of metal material with electrical characteristics such as copper sheet or copper ring; a metal housing 9 is used to hold aforesaid elements, wherein, one end of the metal housing 9 has a holding portion 91 mainly using to hold the metal braid 7 and the conducting part 6' enclosed outside; and an outer jacket 2 is used to enclose the aforesaid elements.

According to the aforesaid structure, the embodiment of the present invention mainly has made the metal housing 9, the metal braid 7 holed by the holding portion 91 of the metal housing 9, and conducting part 7 fully conducting to generate electrical characteristics, such that the present invention can generate a second grounding effect; therefore, the embodiment of the present invention has better electrical characteristics.

Therefore, the electrical connector with grounding structure of the present invention makes the cable assembly of the present invention has grounding effect without any grounding line positioned inside the cable assembly; furthermore, it also can lessen the soldering process and prevent the mistaken probability of the soldering process generated such that the entire assembly process and the relative cost can be reduced.

Therefore, the present invention relates to an electrical connector with grounding structure suitable for high frequency transmitting. The high frequency connector mainly has grounding part inserted inside the insulating body contacted with the jacket layer enclosed over the signal transmitting units with fixing and contacting effect for generating electrical characteristics, such that the cable assembly of the electrical connector has grounding effect without any grounding line positioned inside cable assembly; furthermore, it also can lessen the soldering process and prevent the mistaken probability of the soldering process generated such that the entire assembly process and the relative cost can be reduced.

Although a particular embodiment of the invention has been described in detail for purposes of illustration, various modifications and enhancements may be made without departing from the spirit and scope of the invention. Accordingly, the invention is not to be limited except as by the appended claims.

The invention claimed is:

1. An electrical connector with a grounding structure comprising:

a) an insulating body;

b) a plurality of transmitting terminals inserted into the insulating body;

c) a cable assembly having:

i) a plurality of conductive jacket layers;

ii) a plurality of transmitting units, each of the plurality of transmitting units having an outer periphery surrounded by one of the plurality of conductive jacket layers, one of the plurality of transmitting units is positioned above each of the plurality of transmitting terminals; and d) a grounding part having:

i) a contacting part contacting the plurality of conductive jacket layers; and ii) a plurality of grounding terminals extending outwardly and inserted into the insulating body;

e) first and second conducting parts, the first conducting part having an insulating layer covering an outer surface thereof and surrounding the plurality of conductive jacket layers and the grounding part, and the second conducting part surrounding the metal braid;

f) a metal housing encasing the insulating body, the plurality of transmitting terminals, the cable assembly, the grounding part, and the first and second conducting parts, the metal housing having a holding portion located on a end thereof and engaging an outer periphery of the second conducting part; and g) an outer jacket encasing metal housing.

2. The electrical connector according to claim 1, wherein each of the plurality of conductive jacket layers is an aluminum foil Mylar.

3. The electrical connector according to claim 1, wherein the grounding part is made of a conductive material.

4. The electrical connector according to claim 1, wherein the conducting part is made of a metal material selected from a group consisting of copper sheet and copper ring.

5. The electrical connector according to claim 1, wherein the insulating layer is an insulating gummed tape.

6. The electrical connector according to claim 1, wherein each of two opposing sides of the contacting part includes a wing portion.

* * * * *